United States Patent [19]

Shears

[11] Patent Number: 4,951,341

[45] Date of Patent: Aug. 28, 1990

[54] WALL AND CEILING MOP

[76] Inventor: Mary Shears, 26 Crabwood Ct., Youngstown, Ohio 44515

[21] Appl. No.: 314,802

[22] Filed: Feb. 24, 1989

[51] Int. Cl.[5] ..... A47L 13/20

[52] U.S. Cl. ..... 15/228; 15/147 R; 15/224

[58] Field of Search ..... 15/147 R, 147 A, 147 B, 15/220 R, 223, 224, 228, 229.1, 229.2, 229.6, 229.7, 229.8, 231

[56] References Cited

U.S. PATENT DOCUMENTS

| | | | |
|---|---|---|---|
| 763,888 | 6/1904 | Hayden | 15/223 |
| 878,606 | 2/1908 | Bryant . | |
| 1,381,879 | 6/1921 | Juska . | |
| 2,161,725 | 6/1939 | Smith | 15/223 |
| 2,489,158 | 11/1949 | Rodgers | 15/147 R |
| 2,595,536 | 5/1952 | Pastoret | 15/224 |
| 2,601,689 | 7/1952 | Mallard | 15/231 |
| 2,655,680 | 10/1953 | Geerin | 15/228 |
| 3,411,173 | 11/1968 | Berrington et al. | 15/231 |
| 3,792,505 | 2/1974 | Saltzstein | 15/147 A |
| 3,827,099 | 8/1974 | Allaire | 15/229 R |
| 3,991,432 | 11/1976 | Griffin et al. | 15/229.8 |
| 3,996,639 | 12/1976 | Griffin et al. | 15/229.6 |
| 4,114,224 | 9/1978 | Disko . | |

FOREIGN PATENT DOCUMENTS

| | | | |
|---|---|---|---|
| 2419215 | 4/1974 | Fed. Rep. of Germany | 15/229.2 |

*Primary Examiner*—Harvey C. Hornsby
*Assistant Examiner*—M. Spisich
*Attorney, Agent, or Firm*—Harpman & Harpman

[57] ABSTRACT

A wall and ceiling mop is comprised of a plurality of folded flap elements removably secured to a support base. The folded flap elements are segmented and aligned to form radially transverse bands on the support base with intermediate interlocking elements securing the flap elements to the support base.

8 Claims, 1 Drawing Sheet

WALL AND CEILING MOP

BACKGROUND OF THE INVENTION

1. Technical Field:

This device relates to fabric absorptive cleaning mops that utilize multiple fiber bundles to provide an efficient flexible cleaning element mounted on an elongated handle or the like.

2. Description of Prior Art:

Prior Art devices of this type have relied on a variety of different absorptive elements and mounting configurations all directed to supply a plurality of absorptive elements secured to a central support means, see prior example U.S. Pat. No. 878,606, U.S. Pat. No. 1,381,879 and U.S. Pat. No. 4,114,224, and U.S. Pat. No. 3,827,099.

In U.S. Pat. No. 878,606 bundles of brush material are positioned over pivoted bars held at opposite ends within a rigid support frame. The lower longitudinal edges of each of the bars are notched so that they will engage and hold the brush material against the parallel frame members.

U.S. Pat. No. 1,881,879 discloses a mop construction wherein rags or cord elements are compressed and held at their ends by grooved slots. A compression bar is engaged and holds the slots in multiple adjacent relationship in a mounting frame.

U.S. Pat. No. 4,114,224 discloses a mop of non-woven fabric material wherein the material is formed in elongated strips that are slit inwardly from their respective free ends and secured in stacked relation to one another via a central aperture. U.S. Pat. No. 3,827,099 on a disposable mop head is drawn to a mop head made up of a plurality of elongated flexible sheets secured at their edge to a back facing material creating a mass of flexible mopping strips. The strips are concentrated in closer relation to one another in the center of the back facing strip than along the outer edges of said strip.

An alternate form of the invention uses fabric panels slit inwardly from one edge to be secured via a plurality of longitudinally spaced apertures to a support spline. The multiple layers of successive material form a circular mop element configuration with an attached handle.

SUMMARY OF THE INVENTION

A wall and ceiling mop having a plurality of radially aligned bands of flaps positioned in side to side relation to one another on a support base. Each of the bands are formed of independent interconnected pairs of flaps extending between the bands to form a unified removable absorbent mop element.

DESCRIPTION OF THE PREFERRED EMBODIMENT

A wall and ceiling mop as seen in FIGS. 1, 2, and 3 10 of the drawings comprises a generally rectangular support base having a flat central body member 11 with oppositely disposed spaced longitudinal edges 12 and 13 and respective end portions 14 and 15. Each of the edges 12 and 13 are characterized by a compound inverted U-shaped channel extending outwardly from said respective edge and spaced vertically above the horizontal plane of the flat central body member 11.

Figure 2:
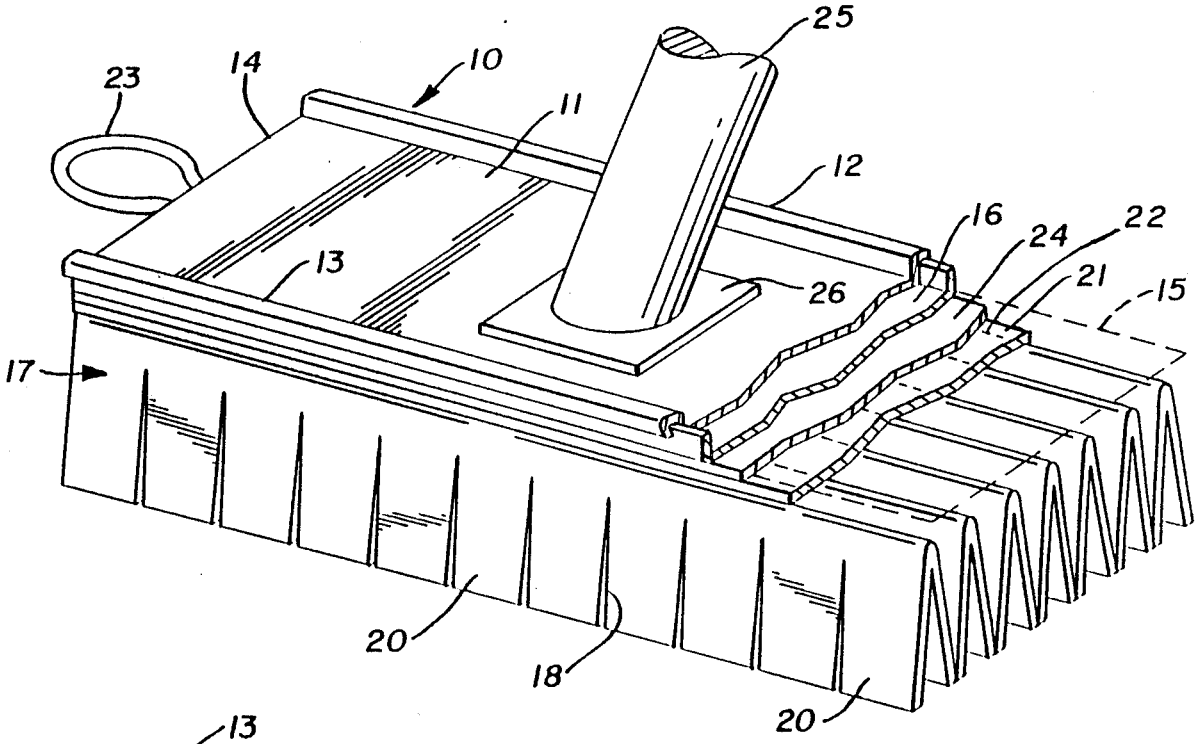
FIG. 2 is a perspective view of the invention with a portion cut away for clarity.
Figure 3:
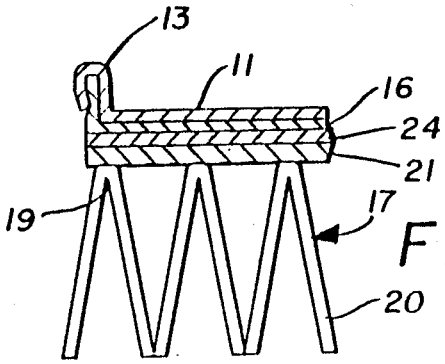
FIG. 3 is an enlarged cross-sectional view of a portion of the invention.

A fabric pad 18 is comprised of velcro® material comprised of hooks and loops is permanently secured to the support base 10 by compression of the channels over the longitudinal edges of the fabric pad 16, as best seen in FIG. 2 of the drawings. A generally rectangular piece of non-woven absorptive material 17 can be seen in FIG. 1 of the drawings which can be any one of a number of highly absorbent non-woven bonded materials currently available on the market as exemplified by the material disclosed in U.S. Pat. No. 4,114,224 of record which can be used for a variety of applications, such as drying cars, clothes, hair and the like and will be familiar to those skilled in that particular area of the art.

The material 17 is cut inwardly from its respective longitudinal edges at 18 in correspondingly spaced relation to each other to a point just short of a center fold line indicated at 19. The cuts at 18 are spaced evenly defining a plurality of absorbent flaps 20 that are folded downwardly in adjacent relation along the fold line at 19 as indicated in broken lines in FIG. 1 of the drawings.

Referring now to FIG. 2 of the drawings a number of folded flaps 20 are secured to a cloth carrier 21 in side by side relation by sewing along a stitch line 22. Removable tabs 23 are secured to the opposite ends of said cloth carrier 21 along with a secondary fabric pad 24 of registering velcro® material which covers the entire exposed surface of said cloth carrier 21 opposite the attached folded flaps 20.

In use, the removal tabs 23 are used to separate the secondary fabric pad 24 of velcro® and the attached folded flaps from the fabric pad 16 of velcro® attached to the support base 10 for ease of replacement and cleaning as necessary.

An elongated handle 25 is affixed to said central body member 11 via an attachment bracket 26 allowing for ease of use in floors and ceiling applications.

It will be evident that the unique multiple transverse bands of flaps of absorbent material positioned on the support base can provide a simple non-tiring and low friction configuration in which to engage the wall or ceiling surface for cleaning which is required periodically in residential and commercial structures.

The wall and ceiling mop reduces the strength and therefore associated strain required in conducting such cleaning which can account in some instances for injury to the user of a standard or typical mop which has a high friction co-efficient and requires a high degree of effort and controlled positioning in order to achieve a effective cleaning engagement with the surface at hand.

Figure 4:
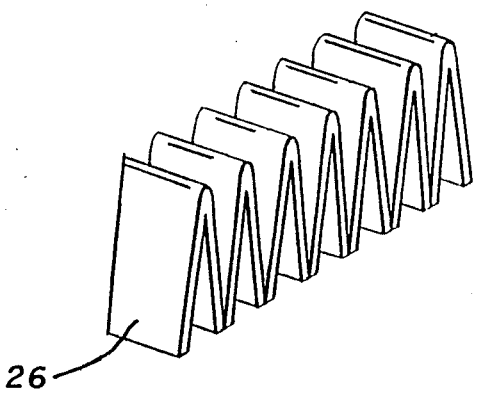
FIG. 4 is a perspective view of an alternate form of the invention.
Figure 1:
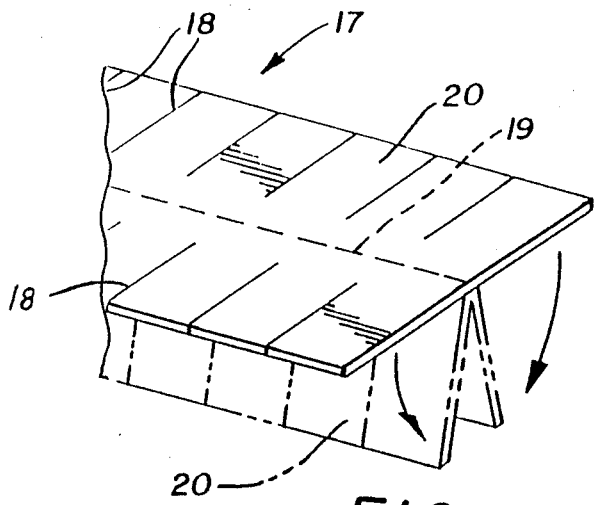
FIG. 1 is a perspective view of absorptive flap elements in flat and folded position.

Referring now to FIG. 4 of the drawings, an alternate form of the invention can be seen wherein a plurality of absorbent flaps 26 can be seen initially formed in a continuous strip. The strip is cut at C to form the flaps after being secured to the cloth carrier 21 as hereinbefore described.

Thus, it will be seen that a new and novel wall and ceiling mop has been illustrated and described and that various changes and modifications may be made therein without departing from the spirit of the invention, therefore I claim:

I claim:

1. A wall and ceiling mop comprising a support base having a first flexible attachment means secured thereto, a plurality of absorptive flaps interconnected to one another at multiple fold lines to form a continuous strip, a carrier means secured to said absorptive flaps at said fold lines, a secondary flexible attachment means secured to said carrier means for removable engagement with said first flexible attachment means, a handle extending from said support base, means for attaching said first flexible attachment means to said support base, severing said interconnected flaps at some of said multiple fold lines, opposite said carrier to form said plurality of absorptive flaps.

2. The wall and ceiling mop of claim 1 wherein said first and second flexible attachment means comprises releaseable registrable fabric fasteners of hooks and loops interengaging material.

3. The wall and ceiling mop of claim 1 wherein said plurality of absorptive flaps are secured to said carrier means via said fold line comprises fabric stitching or the like.

4. The wall and ceiling mop of claim 3 wherein said means for attaching said first flexible attachment means to said support base comprises a compound inverted U-shaped channel on oppositely disposed longitudinal edges of said support base by compression of said channel against said first flexible attachment means.

5. The wall and ceiling mop of claim 1 wherein said plurality of absorbent flaps interconnected to one another at said fold line are secured transversely on said support base to form bands of absorptive flaps positioned in evenly spaced independent pairs across said support base.

6. The wall and ceiling mop of claim 1 wherein said carrier means is of absorbent material.

7. A wall and ceiling mop comprising a support base having a first flexible attachment means secured thereto, a plurality of absorptive flaps interconnected to one another at multiple fold lines to form a continuous strip, a carrier means secured to said absorptive flaps at set fold lines, a secondary flexible attachment means secured to said carrier means for removable engagement with said first flexible attachment means, means for attaching said first flexible attachment means to said support base, severing said interconnecting flaps at some of said multiple fold lines opposite said carrier to from said plurality of absorptive flaps.

8. The wall and ceiling mop of claim 7 wherein said first and second attachment means comprises releaseable registrable fabric fasteners of hook and loops interengaging material.

* * * * *